United States Patent [19]

Yasue

[11] Patent Number: 4,555,421

[45] Date of Patent: Nov. 26, 1985

[54] FILLING MATERIAL

[75] Inventor: Kazo Yasue, Utsunomiya, Japan

[73] Assignee: Anmin Manufacturing Co., Ltd., Tokyo, Japan

[21] Appl. No.: 609,905

[22] Filed: May 11, 1984

Related U.S. Application Data

[63] Continuation of Ser. No. 128,468, Mar. 7, 1980.

[30] Foreign Application Priority Data

May 23, 1979 [JP] Japan ..... 54-63546

[51] Int. Cl.[4] ..... A41G 11/00

[52] U.S. Cl. ..... 428/6; 428/371

[58] Field of Search ..... 428/6, 245, 369, 371

[56] References Cited

U.S. PATENT DOCUMENTS

| | | | |
|---|---|---|---|
| 1,024,272 | 4/1912 | Metzger | 428/6 X |
| 1,177,960 | 4/1916 | Michel | 428/6 |
| 3,892,909 | 7/1975 | Miller | 428/6 X |

*Primary Examiner*—Henry F. Epstein

*Attorney, Agent, or Firm*—Armstrong, Nikaido, Marmelstein & Kubovcik

[57] ABSTRACT

A filling material composed of an assembly or assemblies of looped fibers which are bonded together at one point. The filling material of the present invention can be used instead of down and feather as fillings of pillows, cushions, quilts et al.

16 Claims, 4 Drawing Figures

FILLING MATERIAL

This is a continuation of application Ser. No. 128,468, filed Mar. 7, 1980.

BACKGROUND OF THE INVENTION

Down and feather are ordinarily used as fillings of pillows, cushions and quilts, and down and feather of ducks or geese are used in large quantities. Recently, however, the output of these down and feather can hardly catch up with increasing consumption thereof and the price of them is remarkably increasing.

Under such background, the inventor made researches with a view to developing artificial down and feather that can be used instead of natural down and feather, and as a result, the present invention has now been completed.

DETAILED DESCRIPTION OF THE INVENTION

The present invention relates to a filling material. More particularly, the invention relates to a filling material composed of synthetic fibers, which is used instead of down and feather in the fields where down and feather have heretofore been used.

Feather are roughly divided into ordinary feather and down. In the present invention, it is intended to obtain a filling material that can be mainly used in the fields where fillings of downs have heretofore been used and is also intended to obtain a filling material that can be used in the fields where fillings of feather have been used.

Fibers of polyester, nylon, polyacrylonitrile and the like are used as fibers constituting the filling material of the present invention. Polyester fibers having a high Young's modulus are especially preferred.

It is preferred that the fineness of fibers be 1.5 denier to 15 denier, particularly about 4 denier to about 6 denier. Crimped synthetic fibers may be used in the present invention and the preferred average crimp number of fibers are 4 to 15 crimps per inch, particularly 5 to 8 crimps per inch. Such fibers can be obtained by cutting a fiber tow or filaments into an appropriate length and crimping is preferably performed in the state of a tow or filaments. A mixture of a crimped tow or filaments and an uncrimped tow or filaments may be used. In view of the bulkiness and nonentangling characteristic, it is preferred that filaments constituting such tow should have a cross-section of a circular shape, tri-lobar triangular shape, ume flower-like pentagonal shape or hexagonal shape.

In order to prevent entanglement of fibers of the filling material and impart a good drapability to the filling material, a lubricant is applied to the surfaces of the filaments so that the dynamic friction coefficient is about 0.10 to about 0.20.

As the lubricant, there can be used lubricants having a good spray-permeability, for example, an emulsion of a tetrafluoroethylene resin, an aqueous solution of an organopolysiloxane having an isocyanate group, and a silicone resin composed mainly of dimethyl polysiloxane. Nonionic surfactant can be also applied to the fibers as the lubricant. Such lubricant is applied to the surfaces of filaments constituting the tow by spraying or dipping.

The filling material of the present invention is made from the above-mentioned fibers. Embodiments of the filling material of the present invention will now be described.

Figure 1:
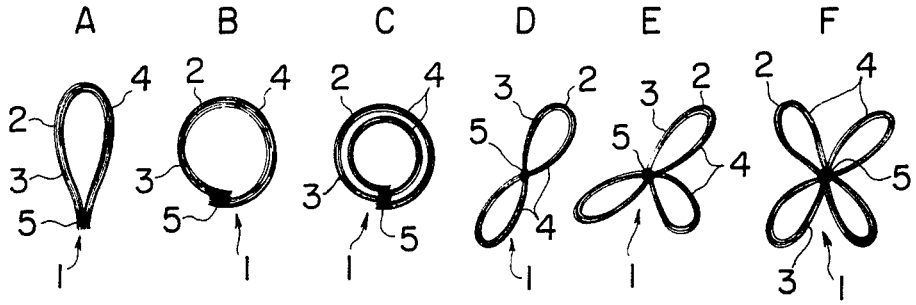
FIGS. 1-A, 1-B, 1-C, 1-D, 1-E and 1-F are perspective views illustrating embodiments of the filling material according to the present invention.

Embodiments of a filling material 1 according to the present invention are illustrated in FIG. 1. In the filling material 1 of the present invention, a bundle 3 of fibers 2 is bent to form a loppy portion 4, and the fibers 2 constituting the loopy portion 4 are gathered at one point 5 and they are integrally bonded together at said gathering point 5. Bonding means is not particularly critical. Namely, the fibers can be bonded together by fusion bonding under heating or by using an adhesive or by applying an ultrasonic method. In an embodiment shown in FIG. 1-A, the loopy portion 4 has a water drop-like shape. This water drop-like shape is formed because both the end portions of the gathered fibers are arranged in the same direction at the gathering point. If the fibers are bonded at the gathering point so that both the end portions of the fibers are arranged in the opposite directions, the loopy portion comes to have a circular shape as shown in FIG. 1-B. In an embodiment shown in FIG. 1-C, a loopy portion 4 is formed in the same manner as in the embodiment shown in FIG. 1-B but the loopy portion 4 is doubled. If desired, a three-ply or multiple-ply arrangement may be adopted for the loopy portion 4. An embodiment shown in FIG. 1-D is a modification of the embodiment having a water drop-like loopy portion 4, shown in FIG. 1-A, where the loopy portion 4 is symmetrically projected to both the sides with the gathering point 5 being as the center. In embodiments shown in FIG. 1-F, the number of loopy portions 4 as formed in the foregoing embodiments is increased and these loopy portions 4 are radially projected to the periphery with the gathering point 5 being as the center.

Figure 3:
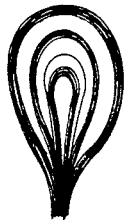
FIG. 3 is a perspective view illustrating another embodiment of the filling material of the present invention.
Figure 4:
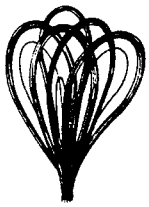
FIG. 4 is a view illustrating the condition of the fillings in which looped fibers are expanded.

The loopy portion 4 may be composed of fibers having different length as shown in FIG. 3. In this embodiment, the loopy portion may have any shape as illustrated in FIGS. 1-A to 1-F. When the fibers having different length are used for constituting the loopy portion, each fiber being composed of the filling material is more expanded so that the expanded fibers are soft in touch as like as the barks of the feather are and the gathering point 5 acts as the quill of the feather. In FIGS. 1 and 3, the fibers being composed of the loopy portion are illustrated to be remaining arranged condition. The fibers, however, are expanded as shown in FIG. 4 when they are used as the filling material.

Figure 2:
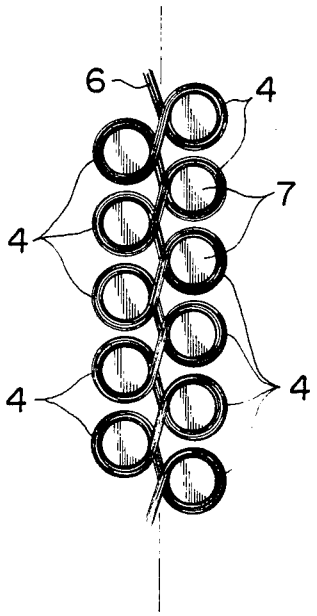
FIG. 2 is a diagram illustrating the process for preparing the filling material of the present invention.

One embodiment of the process for producing a filling material as shown in FIG. 1-A will now be described. A tow or filaments 6 which has been subjected to the above-mentioned crimping and lubricating treatments according to need is hung on pins 7 arranged in a zigzag manner so that S-shaped portions continuous to one another are formed as shown in FIG. 2. The tow or filaments 6 having loopy portions 4 thus formed is cut at crossing points into fibers 2 bent in a loopy configuration, and simultaneously, the cut ends are fusion-bonded together under heating. By this cutting operation, the tow or filaments 6 is formed into a filling material which is composed of a bundle of fibers 2 being bent in a loopy configuration and having the ends thereof fusion-bonded together as shown in FIG. 1.

As described hereinbefore, the filling material of the present invention is composed of a plurality of fibers bent in a loopy configuration, and since these fibers are gathered at one point and they are integrally bonded together at this gathering point, the fibers exert a high elasticity to an external pressure when a pressure is applied to the fibers from the outside. Accordingly, when the filling material of the present invention is actually used as fillings, many air spaces are formed among the fibers by the elastic force of the fibers which are contacted with one another. Therefore, the filling material of the present invention has the same good elasticity and temperature-retaining property as fillings composed of natural down and feather have.

Furthermore, in the filling material of the present invention, since the constituent fibers have an annular loopy configuration, any external pressure can be resisted irrespectively of the pressure-applying direction, and furthermore, entanglements are not caused among adjacent fibers and broad air spaces are formed among the fibers.

What is claimed is:

1. A filling material which simulates feathers and which is composed of a plurality of resilient fibers of an elongated, substantially cylindrical bundle of fibers, at least some of the fibers having different lengths, said fibers being bent into a loopy configuration wherein the center of the loopy configuration is large in comparison to the diameter of the bundle of fibers, the opposite ends of said fibers being gathered at one point and bonded together at the one point such that there are substantially no free fiber ends and wherein some of the fibers bent into the loopy configuration have different angular orientation of the loopy configurations formed thereby such that the filling material is substantially three dimensional.

2. A filling material as set forth in claim 1, wherein the opposite ends are pointed in opposite directions and the loopy configuration is a circular shape.

3. A filling material as set forth in claim 1, wherein the opposite ends of the fibers are pointed in the same direction, whereby the loopy configuration is a water drop-like shape.

4. A filling material as set forth in claim 1, wherein a plurality of loopy configurations are integrally bonded together at the one point and extending in different directions therefrom.

5. A filling material as set forth in claims 1 or 2, in which the fibers have a cross-sectional shape selected from a circular shape, tri-lobar triangular shape, ume flower-like pentagonal shape or hexagonal shape.

6. A filling material as set forth in claims 1 or 2, in which the fibers are from about 1.5 to 15 deniers.

7. A filling material as set forth in claims 1 or 2, in which the fibers are from about 4 to 6 deniers.

8. A filling material as set forth in claims 1 or 2, in which the fibers are crimped and have 4 to 15 crimps per inch.

9. A filling material as set forth in claim 3, in which the fibers are crimped and have 5 to 8 crimps per inch.

10. A filling material as set forth in claims 1 or 2, in which the fibers are of a synthetic resin.

11. A filling material as set forth in claims 1 or 2, in which the fibers are of polyester, nylon or polyacrylonitrile.

12. A filling material as set forth in claims 1 or 10, in which the fibers are of polyester with a high Young's modulus.

13. A filling material as set forth in claim 2, in which the surface of the fibers have a dynamic friction co-efficient of from about 0.10 to 0.20.

14. A filling material as set forth in claims 1 or 2, in which the fibers are of polyester and having a surface lubricant applied thereon.

15. A filling material which simulates feathers and which is composed of a plurality of resilient fibers of an elongated, substantially cylindrical bundle of fibers, at least some of the fibers having different lengths, said fibers being bent into a loopy configuration wherein the center of the loopy configuration is free of fibers and the diameter of the loopy configuration is large in comparison to the diameter of the bundle of fibers, the said fibers being gathered at one point and bonded together at one point, said one point being at the opposite ends of the fibers bent into the loopy configuration whereby the opposite ends are bonded together so that the filling material has substantially no free ends and said opposite ends of the fibers being pointed in the same direction, whereby the loopy configuration is a water drop-like shape, and wherein some of the fibers bent into the loopy configuration have different angular orientation of the loopy configurations formed thereby such that the filling material is three dimensional.

16. A filling material as set forth in claim 15, wherein a plurality of loopy configurations are integrally bonded together at the one point and extending in different directions therefrom.

* * * * *